US005526532A

United States Patent [19]

Willard

[11] Patent Number: 5,526,532

[45] Date of Patent: Jun. 18, 1996

[54] WATERPROOF AND BREATHABLE GARMENT

[75] Inventor: Ellery T. Willard, Johnstown, N.Y.

[73] Assignee: Gates-Mills, Inc., Johnstown, N.Y.

[21] Appl. No.: 192,448

[22] Filed: Feb. 4, 1994

[51] Int. Cl.[6] ..... A41D 1/04

[52] U.S. Cl. ..... 2/69; 2/115; 2/122; 2/82

[58] Field of Search ..... 2/69, 115, 122, 2/82, 243.1, DIG. 5, 108, 106, 94

[56] References Cited

U.S. PATENT DOCUMENTS

| | | | |
|---|---|---|---|
| 1,015,231 | 1/1912 | Jacobs | 2/115 |
| 2,341,797 | 2/1944 | Lesser . | |
| 3,911,499 | 10/1975 | Benevento et al. . | |
| 4,504,977 | 3/1985 | King et al. | 2/51 |
| 4,649,573 | 3/1987 | Yen . | |
| 5,083,315 | 1/1992 | Dillon, Jr. . | |
| 5,430,896 | 7/1995 | Bisley | 2/239 |

FOREIGN PATENT DOCUMENTS

| | | | |
|---|---|---|---|
| 3601245 | 7/1987 | Germany | 2/108 |
| 2241152 | 8/1991 | United Kingdom | 2/69 |
| 2263225 | 7/1993 | United Kingdom | 2/108 |

*Primary Examiner*—C. D. Crowder
*Assistant Examiner*—Gloria Hale
*Attorney, Agent, or Firm*—Schmeiser, Olsen & Watts

[57] ABSTRACT

The invention is a sweatshirt-type garment that is designed to be breathable and substantially waterproof. The garment does not have any upwardly facing seams and is formed from a two-layer material. The inner layer of the material is a continuous, plastic film of waterproof material. The outer layer is a mesh material that functions to prevent sheeting of any water that impinges on the exterior of the garment.

14 Claims, 2 Drawing Sheets

WATERPROOF AND BREATHABLE GARMENT

FIELD OF THE INVENTION

The invention is in the field of wearing apparel. More particularly, the invention is a waterproof and breathable over-shirt garment designed to be worn in the same manner as a jacket. The garment is made using only a minimum number of seams with each seam located in an area that is not prone to water leakage. In addition, the material that is used to make the garment is composed of two layers. The inner layer is a waterproof material and faces the body of the wearer. The outer layer is a fabric material which forms the exterior of the garment.

BACKGROUND OF THE INVENTION

Throughout the years, a number of improvements have been made in the materials used in the manufacture of waterproof and windproof wearing apparel. Basic rubberized materials have been replaced by advanced new materials that are impermeable to the passage of water while still being breathable whereby some amount of vapor is allowed to pass through the material.

Commonly, raincoats and other similar types of garments that are used to shield the wearer from inclement weather are made from a material that has from one to three layers. When multiple material layers are used, each layer will normally serve a different purpose.

In the most basic and simplest form of a raincoat, a single layer of a plastic material such as polyethylene is used to form the entire garment. The necessary seams between the different portions of the garment are either sewn and taped or made using a heat sealing or adhesive process. Garments of this type, while being lightweight and inexpensive, are often prone to water leakage at the seams and are uncomfortable to wear for prolonged periods due to lack of breathability.

More complex types of protective wear will usually be formed out of two or three layers of bonded material. A garment of this type will typically have an inner layer made from a cotton or similar material and a waterproof outer layer made from a flexible plastic or rubber material. In recent years, breathable waterproof materials such as GORE-TEX as manufactured by the W. L. & Gore Co. have been used for the outer layer of multi-layer garments of this type. These layered garments are a considerable improvement over a basic, single layer garment. However, multi-layer garments will still often suffer from occasional leakage at their seams. In addition, multi-layer garments can be relatively heavy, are expensive to make and are usually too stiff for comfortable or prolonged wear.

SUMMARY OF THE INVENTION

The invention is a waterproof, breathable over-shirt/sweatshirt-type garment that is designed to be worn as an outer covering to protect the wearer from rain or wind. Unlike prior art multi-layer protective garments, a garment in accordance with the invention is lightweight, extremely supple and is comfortable to wear for prolonged periods. Also, the garment is simple to manufacture and is relatively low in cost.

The garment is fabricated using only a minimum number of seams to join the basic parts of the garment. The few seams that are required are located in relatively protected areas. In the preferred embodiment, the garment has a seam located at each side below the sleeves, a seam on the underside of each sleeve and also a single seam across the bottom portion of the front of the garment. The latter seam is optional depending on the uncut width of the material from which the body of the garment is fabricated.

The garment is made from a multi-layered material in which a waterproof and breathable material (such as TRIAD material as manufactured by Enterprise Coatings Inc.) is employed for the inner layer and a textured nylon or similar loose mesh material is employed for the garment's outer layer. In this manner, the outer layer directs water toward the bottom of the garment and minimizes sheeting of the water in which water would travel across the surface of the garment in a sheet-like layer. By preventing sheeting of water on the garment's outer surface, the water is not allowed to collect or stand in the area of any of the seams, which effectively reduces the chance of leakage at any of the seams. Preferably, the nylon or other material that forms the garment's exterior layer is hydrophilic and thereby will tend to wick any water in contact with the material away from the garment's seams and direct it toward the bottom of the garment.

DETAILED DESCRIPTION OF THE DRAWINGS

Figure 1:
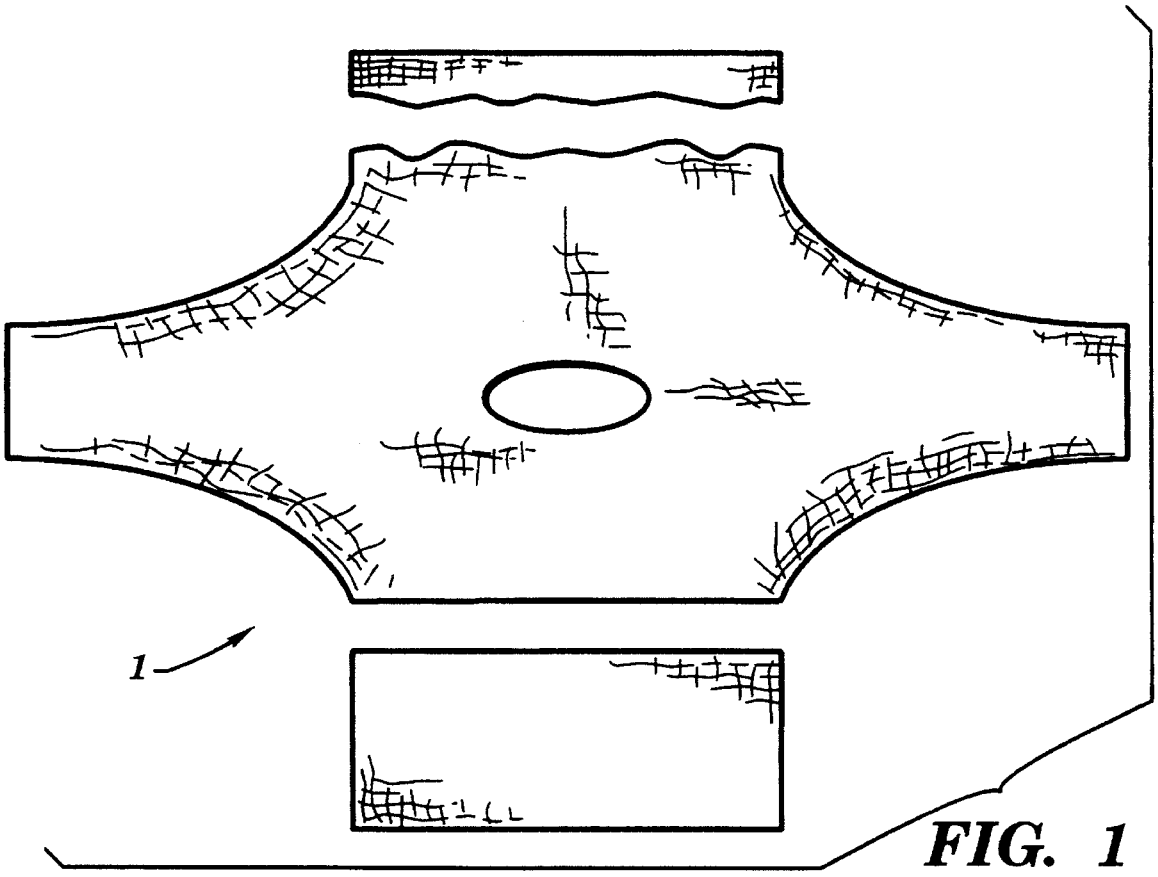
FIG. 1 is a top view of a pattern used to make an over-shirt garment in accordance with the invention.

Referring now to the drawings in greater detail, wherein like reference characters refer to like parts throughout the several figures, there is shown by the numeral 1 a pattern for an over-shirt/sweatshirt-type garment in accordance with the invention.

Figure 2:
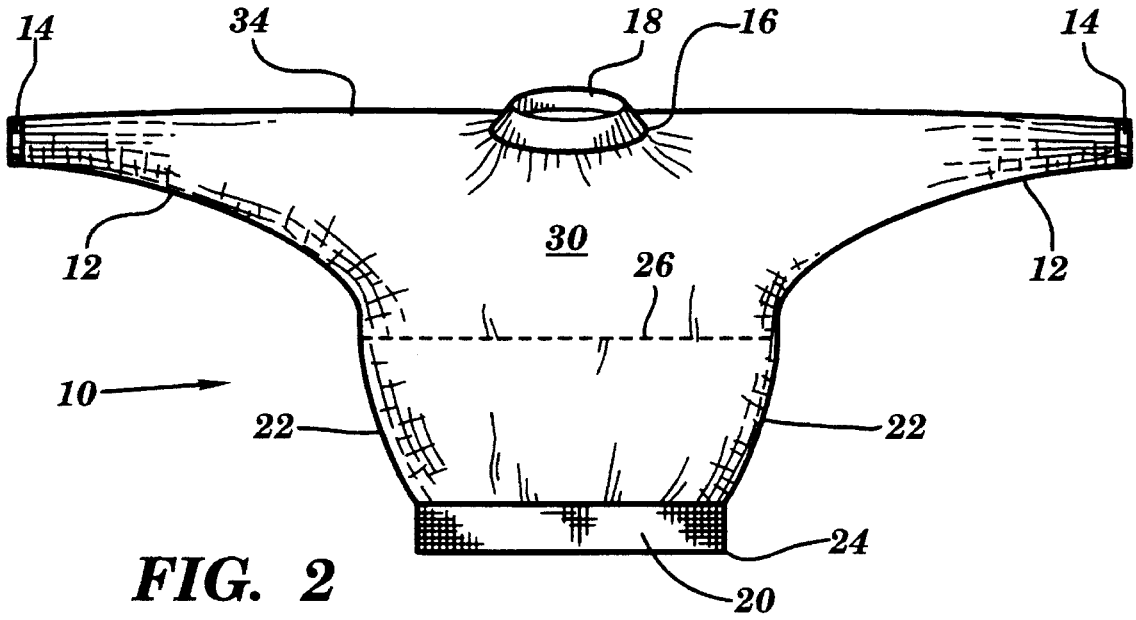
FIG. 2 is a front view of a garment in accordance with the invention.
Figure 3:
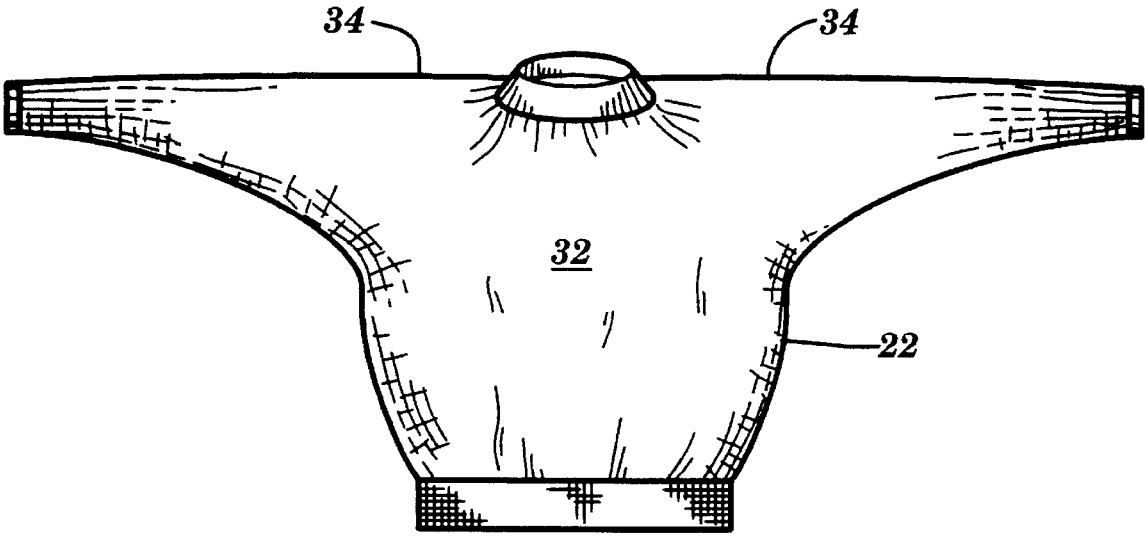
FIG. 3 is a rear view of the garment shown in FIG. 2.
Figure 4:
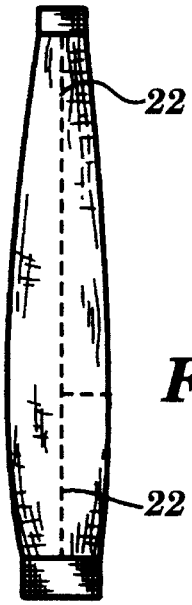
FIG. 4 is a side view of the garment shown in FIG. 2 wherein the arm is shown in a raised position.

FIGS. 2–4 show a garment 10 made using the pattern 1. The garment has two sleeves 12 with each sleeve having an elastic binding 14 located at its distal end. The garment also includes a neck opening 16 that has an elastic binding 18 located about its periphery. The bottom of the garment has a similar elastic binding 20 located about its edge. The elastic bindings 14, 18 and 20 function to make a tight fit of the garment about the wearer to minimize infiltration of water or wind about the edges of the garment.

As can be seen in the figures, the garment is made using only a minimum number of seams. The garment includes two side seams 22 that extend from the garment's bottom edge 24 up to and along the bottom surface of the associated sleeve. In addition, the garment includes one horizontal seam 26 that extends across the lower part of the front 30 of the garment. It should be noted that the back 32 of the garment as well as the garment's shoulders 34 are free of seams. Alternatively, seam 26 can be located on the back 32 of the garment in lieu of on the garment's front 30.

Therefore, the design of the garment enhances its resistance to water leakage since no upwardly facing portion of the garment, such as the shoulders or the tops of the sleeves, has a seam. It should also be noted that the seams are preferably sewn and thereby are extremely flexible. Taping or additional sealing of the seams is not required due to their semi-protected locations.

Figure 5:
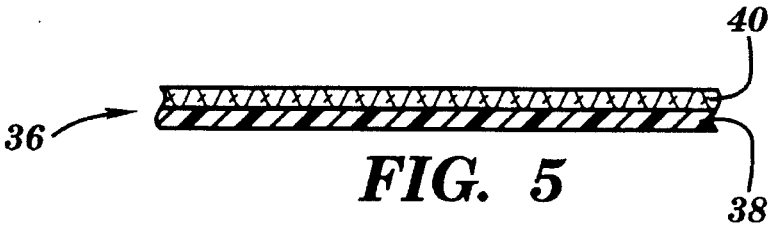
FIG. 5 is a cross-sectional side view of a small portion of the material used to construct the garment of FIG. 2.
Figure 6:
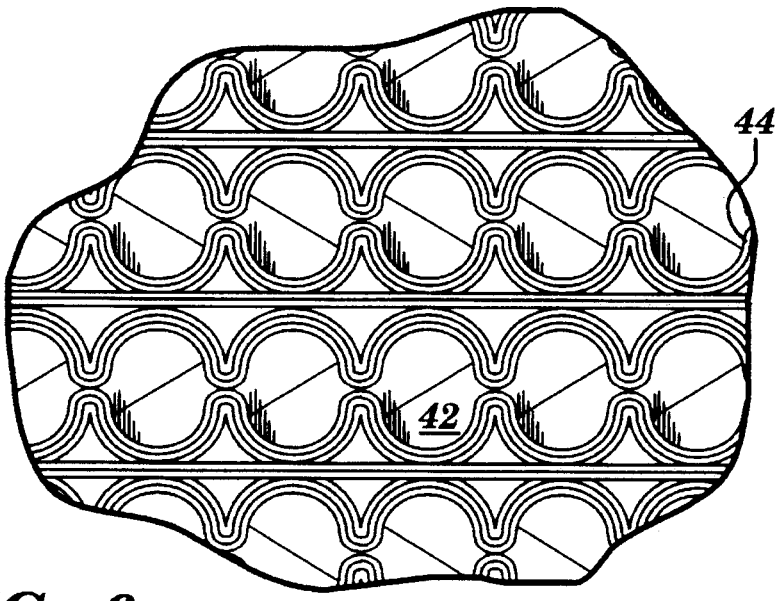
FIG. 6 is a detailed front view of a small area of the surface of the garment shown in FIG. 2.

FIGS. 5 and 6 provide a detailed view of a small area of the garment. The primary focus of these two figures is to provide the viewer with an up-close view of the material 36 used in the fabrication of the garment.

FIG. 5 shows a cross-sectional view of the garment material wherein it can be seen that the material 36 is made up of two distinct layers 38 and 40. Layer 38 is the inner layer and faces the user when the garment is being worn. This layer is preferably a plastic film of TRIAD material (TRIAD is a proprietary material of Enterprise Coatings, Inc.) which is in the class of waterproof and breathable materials similar to GORE-TEX. This material is impervious to water but is "breathable" since it allows no air passage but thru-passage of water vapor.

Layer 40 of the garment material forms the garment's outer layer and is in the form of an open mesh. This layer provides the garment with a uniquely textured outer surface. A detailed view of the mesh is provided in FIG. 6 wherein it can be seen that the garment does not have a smooth outer surface as is commonly found on other waterproof garments.

The mesh of the outer layer comprises a large number of open areas 42 that are surrounded by strands 44 of a preferably hydrophilic material such as a hydrophilic nylon. The open areas are approximately 0.05 inches in diameter and the strands have a height of approximately 0.02 inches. In this manner, the outer surface has a textured configuration with gullies formed by the open areas 42 and ridges formed by the strands of material 44. With this unique type of surface configuration, only small amounts of water can collect in the gullies before the water is then wicked or re-directed by the strands to run off towards the bottom of the garment. This minimizes the amount of time that any particular quantity of water can remain or stand on the surface of the garment before it is drawn or moves toward the bottom of the garment.

The garment's textured surface effectively prevents any water that collects on the garment's surface from sheeting across the garment. By preventing any water from forming a sheet-type layer on the garment's surface, the outer layer 40 minimizes the chance that water will collect at a seam where it would have a tendency to penetrate any small openings in the seam. The above described water-directing tendency of the outer layer is enhanced when a hydrophilic material is used due to the increased wicking action of the strands 44.

It should be noted that the garment 10 can also be made using a non-mesh material such as tricot or taffeta for outer layer 40. The use of a non-mesh material will eliminate most of the water-directing advantages achieved using the previously described uneven outer layer. In addition, the strands 44 of the outer layer can be made from materials that are non-absorbent or which do not tend to wick water. While these latter alternatives will effect the water directing properties of the outer layer, the advantages provided by the garment's inner layer and seam placement will still be provided to the wearer.

Since the garment material 36 is formed from only two thin layers, the material is quite supple and light. By having no seams at the shoulders or on any upwardly facing portion of the garment, the garment's ability to withstand prolonged contact with water from rain is very high.

While the two-layer material 36 has been described herein only for making an over-shirt garment, the same two-layered material can be used in the manufacture of waterproof and breathable pants that are complementary in design and function to the over-shirt garment 10. Pants made using the two-layer material would have the water impervious layer 38 facing the wearer and the textured surface located on the exterior of the garment. In this manner, the outer layer will direct and/or wick any water downwards while preventing the water from sheeting and penetrating the garment's seams.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A light-weight, water-resistant garment comprising:

a top portion having a front portion, a rear portion, first and second shoulder portions, and a top opening, wherein the shoulder portions are free of seams; and a second portion attached at one end to one of the front portion or the rear portion;

wherein said garment is made of an integral material having an inner layer and an outer layer, the inner layer facing the interior of the garment being a wind and water resistant, water vapor permeable material and the outer layer located on the exterior of the garment being a mesh material having a textured surface capable of wicking water.

2. The garment according to claim 1 wherein the mesh material comprises open areas and strands, said strands having a height of approximately 0.02 inches.

3. The garment according to claim 2 wherein the mesh material comprises strands and open areas, said open areas being approximately 0.05 inches in diameter.

4. The garment according to claim 3 wherein each of said sleeve portions has a seam located along a bottom portion thereof.

5. The garment according to claim 4 wherein the second portion and either of the rear portion or the front portion have seams along the sides thereof, thereby forming a bottom opening.

6. The garment according to claim 5 further comprising an elastic means located about the periphery of each of said sleeve portions.

7. The garment according to claim 6 further comprising an elastic means located about the periphery of each of said bottom and top openings.

8. A light-weight, water-resistant garment comprising:

a top portion having a front portion, a rear portion, first and second shoulder portions, and a top opening, wherein the shoulder portions are free of seams; and wherein said garment is made of an integral material having an inner layer and an outer layer, the inner layer facing the interior of the garment being a wind and water resistant, water vapor permeable material and the outer layer located on the exterior of the garment being a mesh material having a textured surface capable of wicking water.

9. The garment according to claim 8 wherein the mesh material comprises open areas and strands, said strands having a height of approximately 0.02 inches.

10. The garment according to claim 9 wherein the mesh material comprises open areas and strands, said open areas being approximately 0.05 inches in diameter.

11. The garment according to claim 10 wherein each of said sleeve portions has a seam located along a bottom portion thereof.

12. The garment according to claim 11 wherein the front and rear portions extend downward and are seamed at the sides thereof, thereby forming a bottom opening.

13. The garment according to claim 12 further comprising an elastic means located about the periphery of each of said sleeve portions.

14. The garment according to claim 13 further comprising an elastic means located about the periphery of each of said top and bottom openings.

* * * * *